US005926097A

United States Patent [19]

Kobayashi et al.

[11] Patent Number: 5,926,097

[45] Date of Patent: Jul. 20, 1999

[54] FUELING SYSTEM

[75] Inventors: Kenji Kobayashi; Kengo Yamazaki, both of Tokyo, Japan

[73] Assignee: Tatsuno Corporation, Tokyo, Japan

[21] Appl. No.: 08/943,598

[22] Filed: Oct. 3, 1997

[30] Foreign Application Priority Data

Feb. 3, 1997 [JP] Japan ..... 9-034433

[51] Int. Cl.[6] ..... G08B 21/00

[52] U.S. Cl. ..... 340/618; 364/479.01; 364/479.02; 364/479.06; 364/479.1; 364/479.11; 364/465; 364/510

[58] Field of Search ..... 340/618; 364/479.01, 364/479.02, 479.06, 479.1, 479.11, 465, 510

[56] References Cited

U.S. PATENT DOCUMENTS

| | | | |
|---|---|---|---|
| 3,949,207 | 4/1976 | Savary et al. | 364/479.06 |
| 4,064,555 | 12/1977 | Ottenstein | 364/465 |
| 4,186,381 | 1/1980 | Fleischer et al. | 340/479.06 |
| 4,247,899 | 1/1981 | Schiller et al. | 364/465 |
| 4,250,550 | 2/1981 | Fleischer | 364/465 |
| 4,572,405 | 2/1986 | Miura | 364/479.1 |
| 4,589,069 | 5/1986 | Endo et al. | 364/405 |
| 5,249,129 | 9/1993 | Lamoureux et al. | 364/479 |
| 5,361,216 | 11/1994 | Warn et al. | 364/510 |
| 5,400,253 | 3/1995 | O'Connor | 364/442 |
| 5,602,745 | 2/1997 | Atchley et al. | 364/464.23 |
| 5,734,851 | 3/1998 | Leatherman et al. | 395/329 |

FOREIGN PATENT DOCUMENTS 8-258897 10/1996 Japan .

*Primary Examiner*—Daniel J. Wu
*Assistant Examiner*—Toan N. Pham

[57] ABSTRACT

A fueling system composed of plurality of fueling units; a control unit mainly for controlling signals transmitted from the fueling units, settling accounts, and indicating fueling states indoors; and an outdoor fueling state indicator for indicating fueling states outdoors by receiving signals from the control unit.

11 Claims, 5 Drawing Sheets

FUELING SYSTEM

BACKGROUND OF THE INVENTION

1. Field of the Invention

The present invention relates to a fueling system to be provided at a gas station for supplying fuel to automobiles, in particular to a fueling system comprising an outdoor fueling state indicator for indicating fueling suspension to fueling operators, and an indoor fueling state indicator for indicating fueling completion to a settling clerk in an office.

2. Discussion of Background

There is disclosed, as Japanese Laid-Open Patent Application 8 (1996)-258897, a fueling system by which fueling suspension is shown to fueling operators and fueling completion is shown to a settling clerk in an office. This type of fueling system is composed of a plurality of fueling units, a point-of-sales (POS) terminal connected to the fueling units by means of signal conductors, an indoor fueling state indicator and outdoor fueling state indicator, each connected to the POS terminal by means of signal conductors.

In the above-mentioned conventional fueling system, the POS terminal connected to fueling units controls both of the outdoor and indoor fueling state indicators, so that POS terminal has to fulfill many functions. As a result, the processing speed of the POS terminal is decreased when the processing capacity thereof is not large enough. In this case, a large investment must be made for replacing the POS terminal by one with a larger capacity.

SUMMARY OF THE INVENTION

It is therefore an object of the present invention to provide a fueling system with an adequate processing speed of a liquidation machine without the necessity of acquiring a liquidation machine with a large processing capacity for much cost.

The above object of the present invention can be achieved by a fueling system comprising: a plurality of fueling units; a control unit mainly for controlling signals transmitted from the fueling units, settling accounts, and indicating fueling states indoors; and an outdoor fueling state indicator for indicating fueling state outdoors by receiving signals from the control unit.

The above-mentioned control unit for use in the present invention comprises a point-of-sales terminal and an indoor fueling state indicator, and signals from the point-of sales terminal is transmitted to the outdoor fueling state indicator invariably through the indoor fueling state indicator.

The object of the present invention can also be achieved by a fueling system comprising: one or more of fueling units; a liquidation machine mainly for controlling signals transmitted from the fueling units, and settling accounts; an indoor fueling state indicator for indicating fueling states indoors by receiving signals from the liquidation machine; an outdoor fueling state indicator for indicating fueling states outdoors by receiving signals from the indoor fueling state indicator, signals from the liquidation machine being transmitted to said outdoor fueling state indicator invariably through said indoor fueling state indicator.

Thus, the burden of the liquidation machine can be decreased in the fueling system of the present invention, with the outdoor fueling state indicator being put under the control of the indoor fueling state indicator.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
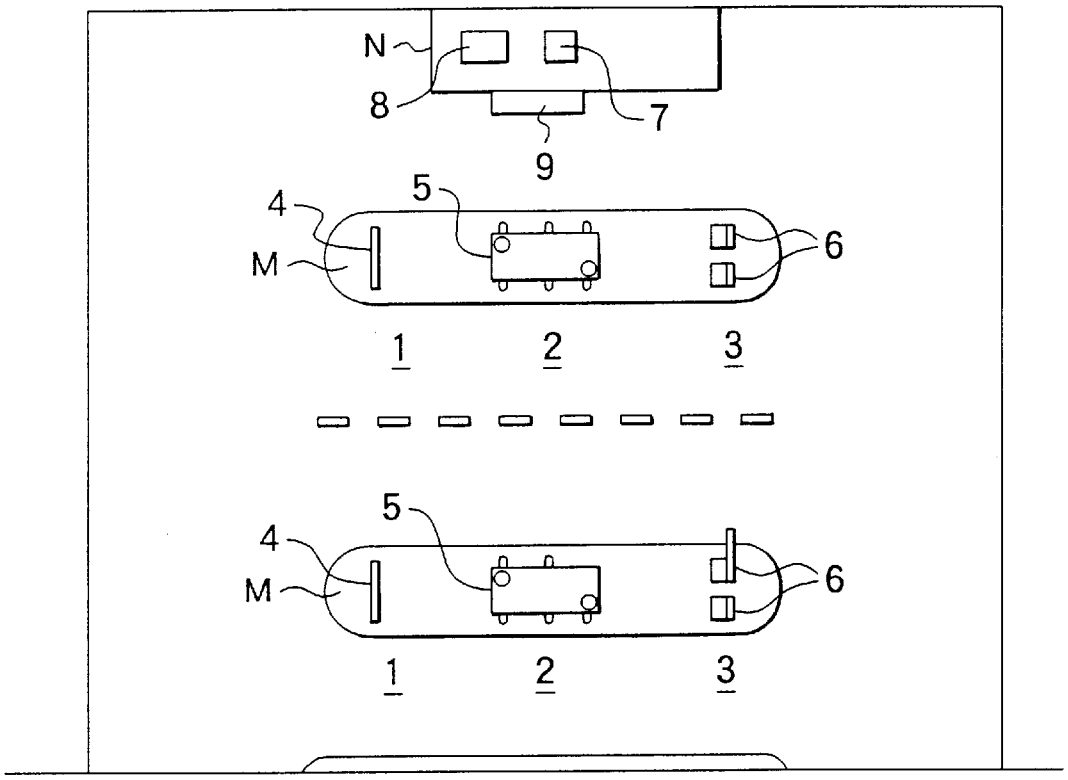
FIG. 1 is a schematic top view of a gas station with an embodiment of a fueling system according to the present invention.

The fueling system of the present invention is composed of a plurality of fueling units; a control unit mainly for controlling signals transmitted from the fueling units, settling accounts, and indicating fueling states indoors; and an outdoor fueling state indicator for indicating fueling states outdoors by receiving signals from the control unit.

The above-mentioned control unit for use in the present invention can essentially be composed of a point-of-sales terminal and an indoor fueling state indicator, and signals from the point-of sales terminal is transmitted to the outdoor fueling state indicator invariably through the indoor fueling state indicator.

Alternatively, the fueling system according to the present invention comprises one or more of fueling units; a liquidation machine mainly for controlling signals transmitted from the fueling units, and settling accounts; an indoor fueling state indicator for indicating fueling states indoors by receiving signals from the liquidation machine; and an outdoor fueling state indicator for indicating fueling states outdoors by receiving signals from the indoor fueling state indicator, signals from the liquidation machine being transmitted to said outdoor fueling state indicator invariably through the indoor fueling state indicator.

The fueling unit for use in the present invention is employed for feeding several kinds of fuel from fueling tubes by way of pumps and flow meters for each kind of fuel. In the fueling unit, a fueling hose is connected to each fueling pipe with a fueling nozzle provided at the top thereof which can be hung on a nozzle rest with a nozzle switch. Signals from the nozzle switch are transmitted to the fueling unit-control part, and signals from the flow-meter is output on a flow-volume indicator of the fueling unit with being output to the liquidation machine such as the POS terminal. The liquidation machine comprises a liquidation-machine control part, which outputs signals to the indoor fueling state indicator in response to input signals from the fueling unit and calculates for settling the fueling fee for customers by receiving signals from the above-mentioned flow-meters. Moreover, the indoor fueling state indicator comprises an indoor-fueling-state-indicator control part, and indoor indication lamps for each of the fueling units. The control part of the indoor fueling state indicator turns on, turns on and off, and turns off the indoor indication lamps depending upon the fueling states for indicating fueling states to the clerk or customers inside an office and outputs signals to the outdoor fueling state indicator which comprises an outdoor-fueling-state-indicator control part and outdoor indication lamps. The outdoor-fueling-state-indicator control part also turns on, turns on and off, and turns off the outdoor indication lamps to give messages about the fueling states to people outside.

The indoor and outdoor fueling state indicators may have communicators to give sounds for aurally indicating fueling suspension to a fueling operator, and fueling completion to an account clerk.

The leaving-propriety indicating unit may be provided at a leaving area of a gas station to which the fueling system of the present invention is installed, in order to appropriately indicate if the car has been fueled with the payment for fueling accomplished or not. The leaving-propriety indicating unit eliminates the possible destruction of the fueling system caused by a car started while fueling.

Other features of this invention will become apparent in the course of the following description of exemplary embodiments, which are given for illustration of the invention and are not intended to be limiting thereof.

The fueling system of the present invention will now be explained by referring to FIG. 1, which is a schematic top view of a gas station with the fueling system, to clearly show the general flow of the operations together with explaining constituents of the system.

A plurality islands M, M are provided in the gas station for supplying several kinds of fuel to automobiles, and entry area 1, fueling area 2, and leaving area 3 are successively formed at the sides of island M. A fueling guide display unit 4 is provided on the top of the island M as to face the entry area 1; fueling units 5, on the middle thereof which faces the fueling area 2; and leaving-propriety indicating units 6, on the rear end which faces the leaving area 3.

Inside an office N, there are provided a liquidation machine 7 and an indoor fueling state indicator 8. Furthermore, an outdoor fueling state indicator 9 is provided at a part which can be seen from every fueling area 2, for instance on the wall of the office N.

Figure 2:
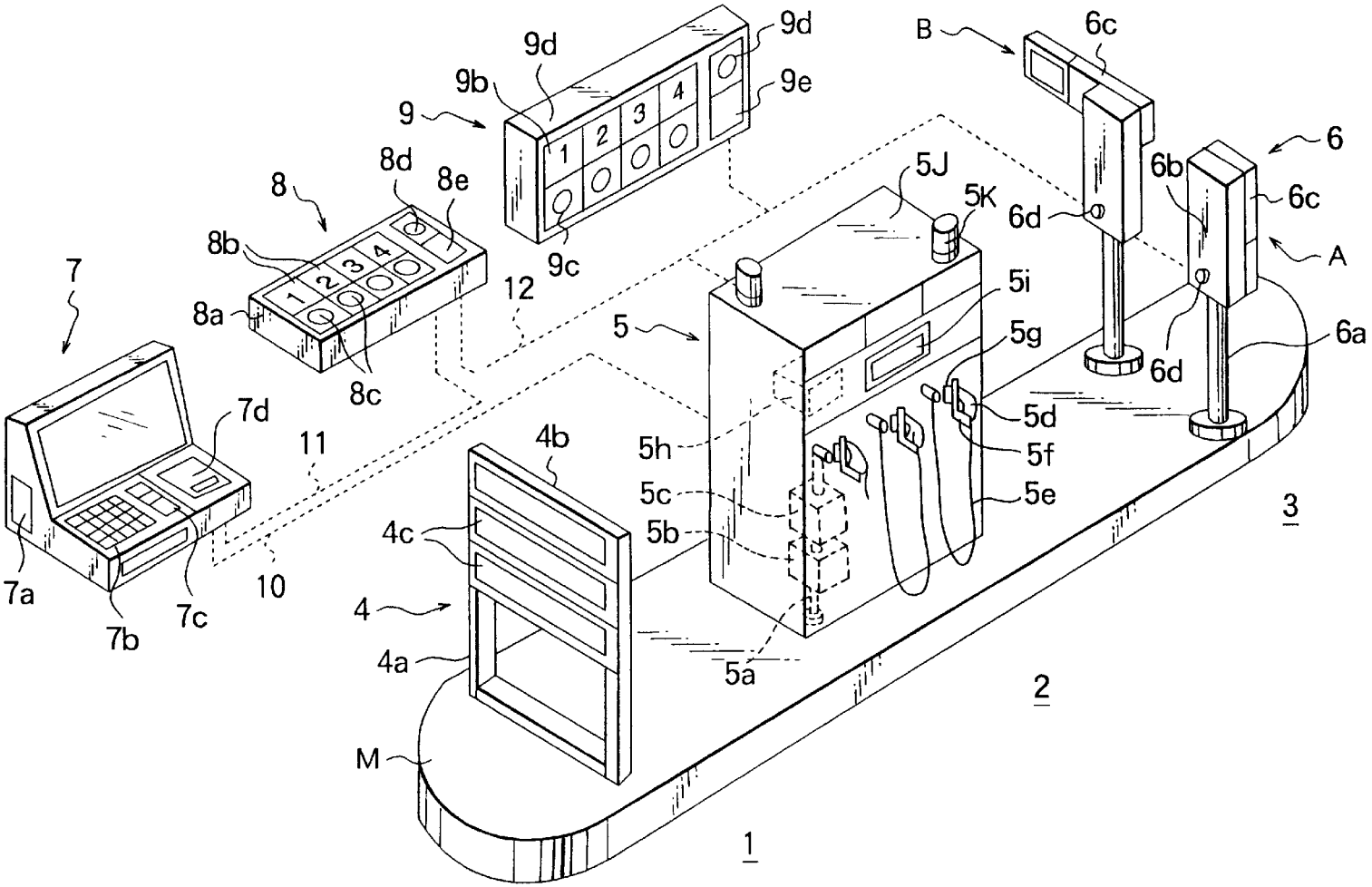
FIG. 2 is a perspective view for explaining constituents of a fueling system as an embodiment of the present invention and the relationship therebetween.

FIG. 2 shows details about each of the island M, that is, a perspective view for explaining constituents of the fueling system and the relationship therebetween. The fueling unit 5 and liquidation machine 7 are connected to each other via a signal conductor 10; the liquidation machine 7 and the indoor fueling state indicator 8 are connected to each other by means of a signal conductor 11; and the indoor fueling state indicator 8, outdoor fueling state indicator 9 and leaving-propriety indicating units 6 are connected via a signal conductor 12.

The fueling guide display unit 4 provided on the island at a top part thereof facing the entry area 1 is composed of a pair of supporting posts 4*a*, a case 4*b* adjusted onto the posts 4*a*, and guide panels 4*c* adjusted to the front surface of the case 4*c*. The kinds of fuel available are shown as "H (high octane), R (regular), D (Diesel), or greetings such as "Welcome" are displayed on the guide panels 4*c*.

Three kinds of fuel, for instance, regular gasoline, high octane gasoline and diesel fuel are incorporated in the fueling unit 5 and two fueling units 5 are contained in a single casing 5J in FIG. 2. Here, the fueling unit 5 is also provided on the central part of the island M, facing the fueling area 2. Pumps 5*b* and flow meters 5*c* are connected to fueling tubes 5*a* in each fueling unit 5. Each of the fueling tubes is connected to a fueling hose 5*e* with a fueling nozzle 5*d* at the tip thereof. A nozzle switch 5*g* for detecting the putting on and off of the nozzle 5*d* is provided on each of the nozzle rests 5*f* for the fueling nozzle 5*d*.

When a nozzle putting off signal from the nozzle switch 5*g* showing the nozzle being put off the nozzle rest 5*f* and a flow-volume signal from the flow-meter 5*c* are input to a fueling-unit control part 5*h*, the control part 5*h* brings the indicate numbers of the previous fuel amount shown in a fuel amount indicator 5*i* to zero, outputs a drive signal to the pump 5*b*, and displays the supplied fuel amount to the fuel amount indicator 5*i* which has been obtained by the calculation based on the flow-volume signal. Thereafter, the control part 5*h* de-energizes the drive signal to the pump 5*b*, receiving the nozzle putting on signal from the nozzle switch 5*g*. As is described below, the control part 5*h* outputs a fueling start signal when received the nozzle putting off signal a fueling completion signal by receiving the nozzle putting off signal from the nozzle switch 5*g*, and the output signals are transmitted to the liquidation machine 7. In addition, the control part 5*h* receives the flow-volume signal from the flow-meter 5*c*, which is output to the liquidation machine 7.

The leaving-propriety indicating unit 6 provided on the island M at the rear top thereof facing the leaving area 3 is composed of a support post 6*a* fixed onto the island M, a main body casing 6*b* adjusted to the top of the support post 6*a*, and an indicating member 6*c*. The indicating member 6*c* is to be fixed in a leaving possible position A with the indicating member 6*c* hung down and in a leaving impossible position B with the indicating member 6*c* made horizontal by the rotation of 90° C. by a reversible motor (not shown) provided in the main body casing 6*b*. Here, the reference symbols A and B are shown with an arrow in FIG. 2. More precisely, the reversible motor causes the indicating member 6*c* to move from the leaving possible position A to the leaving impossible position B when "ON" signal is input by a pressing switch 6*d* provided on the main body casing 6*b* pressed, and from the leaving impossible position B to the leaving possible position A in the case of receiving a liquidation completion signal from the indoor fueling state indicator 8 as is described below.

A so-called POS terminal can be employed as a liquidation machine 7 in the office N. A liquidation-machine control part 7*a* starts to control fueling data of the fueling units 5 by receiving the fueling start signal therefrom, and converts the flow-volume signal to numbers. Thereafter, a fueling slip, on which the converted fueling data is printed, is issued from a printer 7*d* when the issuing key 7*c* on a keyboard 7*b* of the liquidation machine 7 is pressed. Moreover, a fueling signal is output when the flow-volume signal is input from the fueling unit 5, a fueling suspension signal is output when the flow-volume signal is suspended, and the fueling completion signal is output when the fueling completion signal is input, each to the indoor fueling state indicator 8. When the issuing key 7*c* is pressed, the liquidation completion signal is output to the leaving-propriety indicating unit 6.

The indoor fueling state indicator 8 placed in the office N is composed of a main body casing 8*a*, fueling unit-numbers 8*b* indicated in the front surface of the main body casing 8*a*, indoor indication lamps 8*c* provided so as to correspond to fueling unit-numbers 8*b*, an indoor communicator 8*d*, and a control part 8*e*. The control part 8*e* which receives the fueling completion signal causes a corresponding indication lamp to be turned on and off, and the communicator 8*d* to ring. By the receipt of the liquidation completion signal, the control part 8*e* causes the indication lamps to be turned off. The control part 8*e* outputs the fueling signal, fueling suspension signal, and fueling completion signal to the outdoor fueling state indicator 9. The liquidation completion signal is also output from the control part 8*e* to the leaving-propriety indicating unit 6, when the control part 8*e* receives the liquidation completion signal.

The outdoor fueling state indicator 9, which is provided at a place visible from each fueling area 2, such as outer wall of the office N, is composed of a main body casing 9*a*, fueling unit-numbers 9*b* indicated on the front surface of the main body casing 9*a*, outdoor indication lamps 9*c* correspondingly provided to the fueling unit-numbers 9*b*, outdoor communicator 9*d*, and outdoor-fueling-state-indicator control part 9*e*. The control part 9*e* causes the indication lamp 9*c* to be turned on with the receipt of the fueling signal from the indoor fueling state indicator 8, causes the lamp 9*c* to be turned on and off with the communicator 9*d* being rung by the receipt of the fueling suspension signal, and caused the lamp 9*c* to be turned off when the fueling completion signal is received. It is preferable that each of the fueling units 5 have a fueling unit lamp 5K on the casing 5J, which acts in the same way as the outdoor indication lamp 9*c*, for showing the fueling state to people nearby the fueling unit 5.

The operation of the fueling system of the present invention will now be described.

First of all, when there is no car in the gas station, the indicator 6*c* of the leaving-propriety indicating unit 6 is hung down, which is in the leaving possible position A kept drawn seen from the leaving area 3 side. In this case, indication lamps 8*c* and 9*c* are off.

A customer arriving at the gas station for fueling first drives from the entry area 1 where a desired kind of fuel is indicated on the guide panel 4*c* to the fueling area 2 and stops the car therein. When a car stopped at the fueling area 2 is observed, an operator of the gas station presses the pressing switch 6*d* of the leaving-propriety indicating unit 6, the indicating member 6*c* in the hung down state, that is leaving possible position A, rotates to be horizontal in the leaving impossible position B. Thus, the indicating member 6*c* of the leaving-propriety indicating unit 6 protrudes to the leaving area 3 with the indication of leaving impossibility thereon, so that the customer never starts the car by mistake while fuel is being fed.

The operation of the control parts 5*h*, 7*a* and 8*e* of the fueling unit 5, liquidation machine 7, and indoor fueling state indicator 8 will now be explained with referring to the flow-charts shown as FIGS. 3 to 5.

Figure 3:
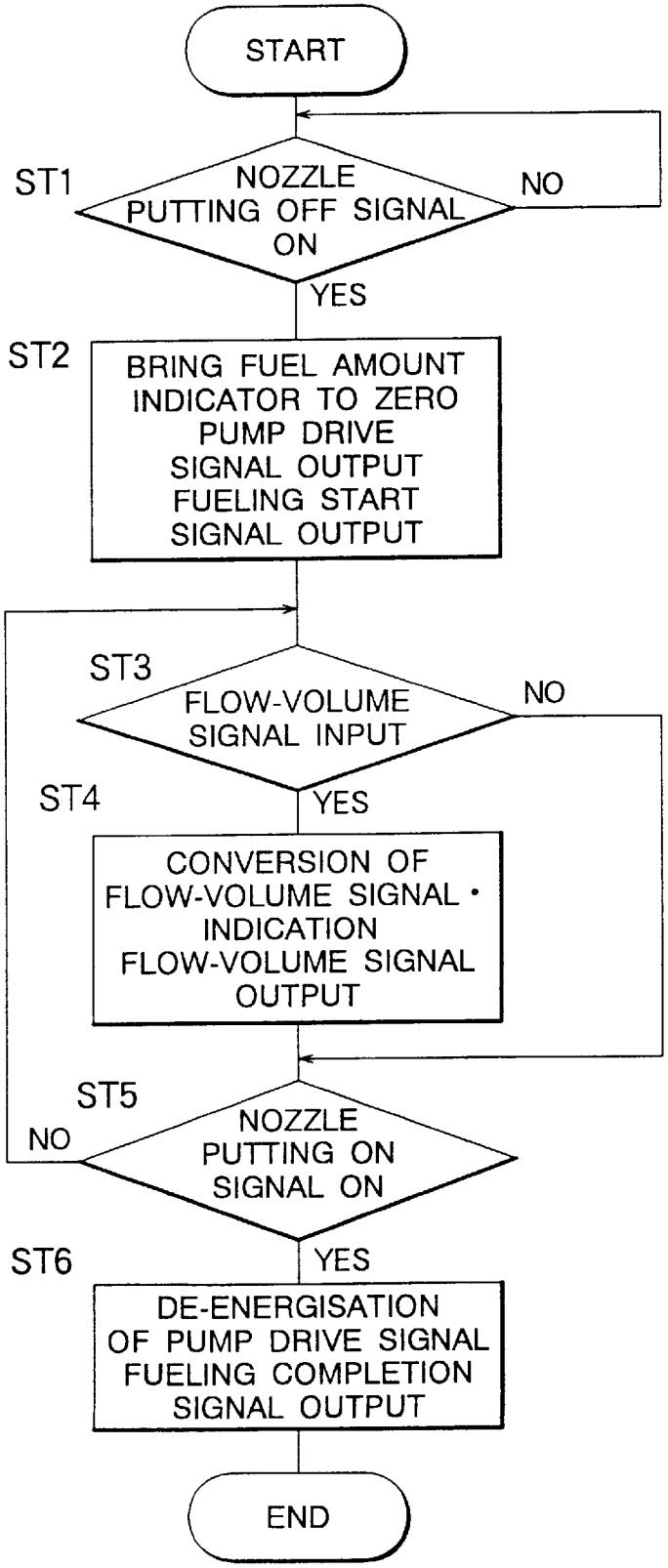
FIG. 3 is a flow-chart for explaining the operation of a control part of a fueling unit for use in a fueling system of the present invention.

As a fueling nozzle 5*d* of the desired kind of fuel is detached from the nozzle rest 5*f*, a nozzle putting off signal is output from the nozzle switch 5*g* to the control part 5*h* (FIG. 3, ST1). Then, the control part 5*h* brings the number indicated on the fuel amount indicator 5*i*, which is the amount of fuel fed by the previous feeding, to zero and outputs a drive signal to a pump 5*b*, and a fueling start signal to the liquidation machine 7 (FIG. 3, ST2) Accordingly, the pump 5*b*is started to drive. When the fueling nozzle 5*d* is inserted to a fueling port of the car and the fueling is started with the valve of the fueling nozzle 5*d* open, the flow-volume signal is input from the flow meter 5*c* to the control part 5*h* (FIG. 3, ST3), the fueled amount is indicated to the fuel amount indicator 5*i* with the flow-volume signal converted to the fueled amount as numbers, and the flow-volume signal is output to the liquidation machine 7 (FIG. 3, ST4).

Figure 4:
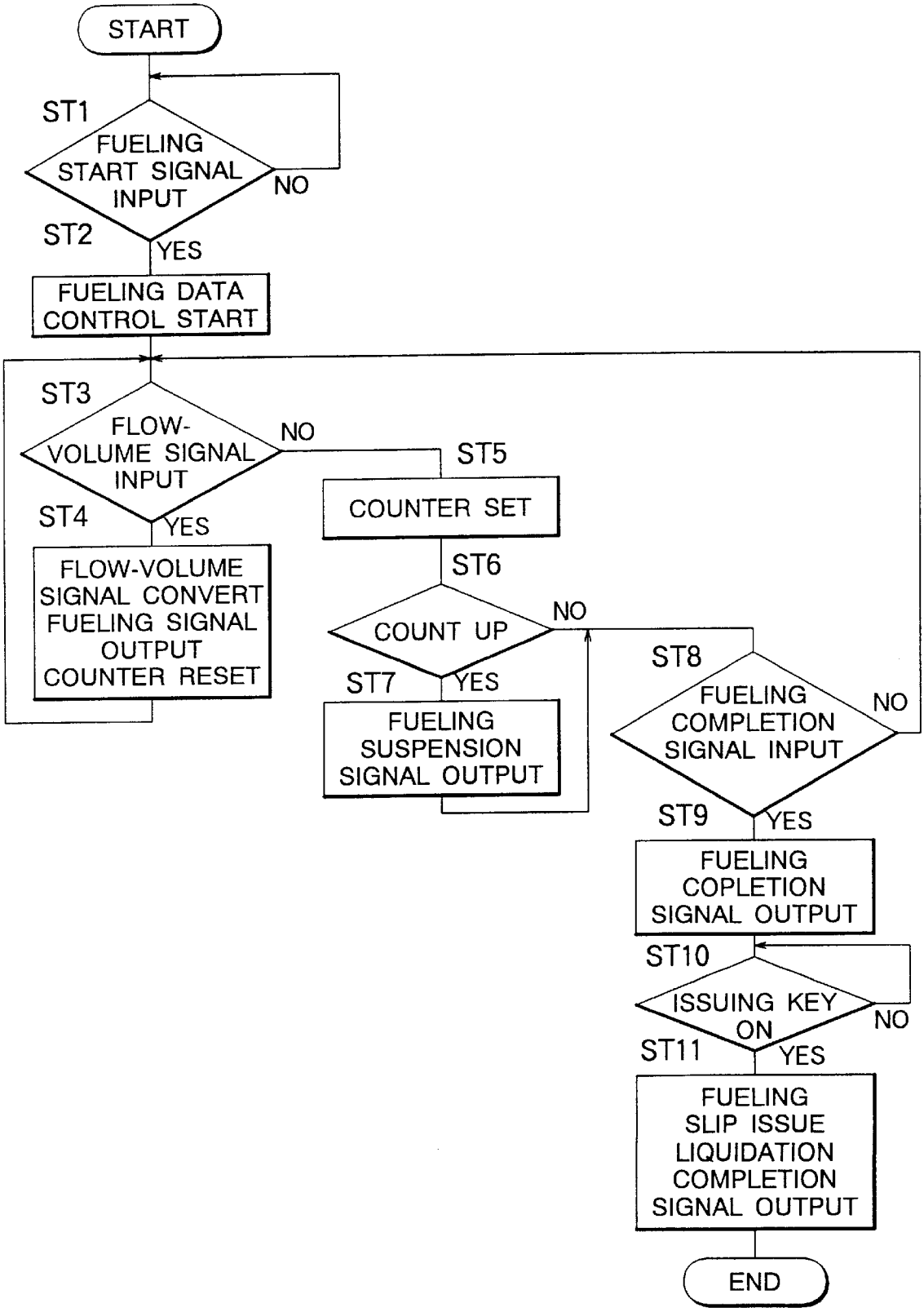
FIG. 4 is a flow-chart for explaining the operation of a control part of a liquidation machine for use in a fueling system of the present invention.

When, when the fueling start signal is received by the liquidation-machine control part 7*a* (FIG. 4, ST1), the control part 7*a* begins to control fueling data of the fueling unit 5 (FIG. 4, ST2). Then, the flow-volume signal is input to the control part 7*a* (FIG. 4, ST3), the flow-volume signal is converted, the fueling signal is output to the indoor fueling state indicator 8, and the counter, which is explained below, is reset (FIG. 4, ST4).

As the fueling signal is input from the liquidation machine 7 to the indoor fueling state indicator 8 (FIG. 5, ST1), the indication lamp 8*c* is turned on and the fueling signal is output to the outdoor fueling state indicator 9 (FIG. 4, ST2). The control part 9*e* of the outdoor fueling state indicator 9 turns on the corresponding indication lamp 9*c* to the fueling unit 5 by receiving the fueling signal.

Thus, fueling progresses, and the fuel tank of the car is almost filled up. In this state, fueling is suspended by the liquid level being detected. Accordingly, the input of the flow-volume signal from the fueling unit 5 to the liquidation machine 7 is stopped (FIG. 4, ST3), and then a counter for counting the fueling suspension time is set (FIG. 4, ST5). If the fueling suspension time continues for a predetermined period, for instance 3 seconds or more, the counter counts up (FIG. 4, ST6), and the control part 7*a* of the liquidation machine 7 outputs the fueling suspension signal to the outdoor fueling state indicator 8 (FIG. 4 T7). The control part 8*e* which has received the fueling suspension signal (FIG. 5, ST3) outputs the fueling suspension signal to the outdoor fueling state indicator 9 (FIG. 5, ST4), whereby the control part 9*e* of the outdoor fueling state indicator 9 causes the indication lamp 9*c* to be turned on an off, and the communicator 9*d* to ring.

As is explained above, a fueling operator while doing other operations can notice the fueling suspension of the fueling because of the outdoor indication lamp 9*e* which turns on and off and the sound of the outdoor communicator 9*d*. Then, the fueling operator opens the valve of the fueling nozzle 5*d* again to add some fuel to the fueling tank of the car in order to fill make the tank completely with fuel.

When the fueling operator opens the valve of the fueling nozzle 5*d* as mentioned above, a flow-volume signal is input from the fueling unit 5 to the liquidation machine 7 (FIG. 4, ST3), a fueling signal is output to the indoor fueling state indicator 8, and the counter for counting the fueling suspension period is reset (FIG. 4, ST4). Thereafter, the indoor fueling state indicator 8 which has received the fueling signal (FIG. 5, ST5) outputs the fueling signal to the outdoor fueling state indicator 9 (FIG. 5, ST6), so that the indication lamp 9*c* of the outdoor fueling state indicator 9 is turned on again.

As the fuel tank of the car is filled with fuel in accordance with the above-mentioned procedure, the fueling nozzle 5*d* is hung on the nozzle rest 5*f* and the nozzle switch 5*g* outputs nozzle hung signal to the fueling unit 5 (FIG. 3, ST5). Responding this, the control part 5*h* of the fueling unit 5 de-energizes the drive signal for the pump 5*b*, whereby fueling completion signal is output to the liquidation machine 7 (FIG. 3, ST6). Following the receipt of the fueling completion signal by the control part 7*a* of the liquidation machine 7 (FIG. 4, ST8), the fueling completion signal is output to the indoor fueling state indicator 8 (FIG. 4, ST9). The indoor fueling state indicator 8 which has received the fueling completion signal (FIG. 5, ST7) rings the communicator 8*d* under turning the indication lamp 8*c* on and off, and then the fueling completion signal is output to the outdoor fueling state indicator 9 (FIG. 5, ST8). The outdoor fueling state indicator 9 having received the fueling completion signal turns off the indication lamp 9*c*.

By the sound of communicator 8*d* and the indication lamp 8*c* turning on and off, a settling clerk notices the end of fueling and can settles an account right away. Here, the customer comes into the office N to pay money for fueling by himself. Where a issuing key 7*c* of the liquidation machine 7 is pressed (FIG. 4, ST10), a fueling slip is issued from a printer 7*d*, with fueling data being printed thereon. The fueling completion signal is output to the indoor fueling state indicator 8 (FIG. 4, ST11).

Figure 5:
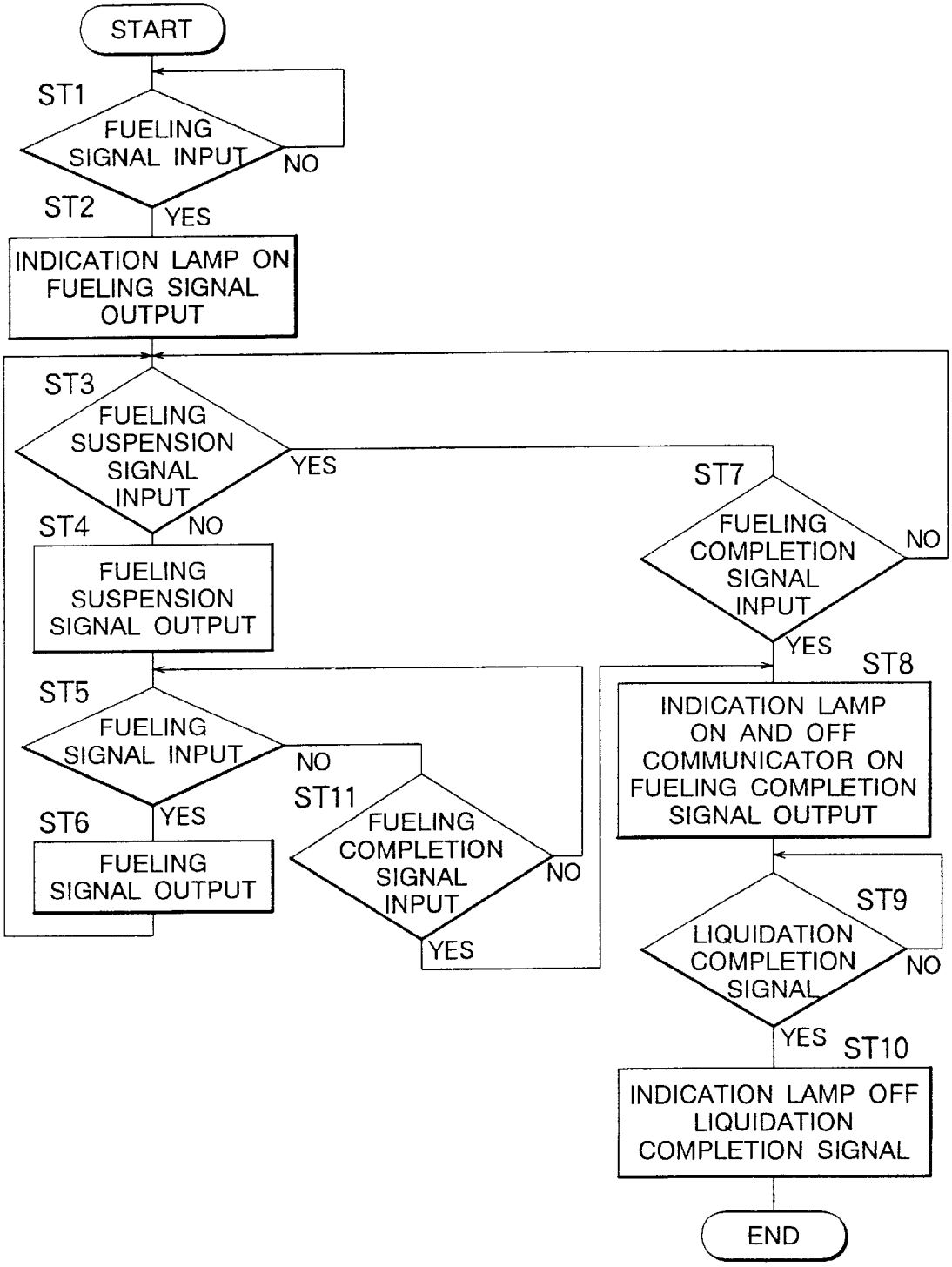
FIG. 5 is a flow-chart for explaining the operation of a control part of an indoor fueling state indicator for use in a fueling system of the present invention.

The indoor fueling state indicator 8 which has received the liquidation completion signal (FIG. 5, ST9) turns off the indication lamp 8*c*, and outputs the liquidation completion signal to the leaving-propriety indicating unit 6 (FIG. 5, ST10). By being received the liquidation completion signal, the leaving-propriety indicating unit 6 rotates the indicating member 6*c* from the leaving impossible position B to leaving possible position A. The car after fueling can leave from the gas station by moving from the fueling area 2 to the leaving area 3 after the indicating member 6*c* is brought into the position A.

As previously mentioned, if the fueling is completed without additional fueling after the fueling suspension for a predetermined period and the fueling completion signal is input from the fueling unit 5 to the indoor fueling state indicator 8 via a liquidation machine 7 (FIG. 5, ST11), control part 8*e* of the indoor fueling state indicator 8 causes the indication lamp 8*c* to be turned on and off, and to output the fueling completion signal to the outdoor fueling state indicator 9 (FIG. 5, ST8), whereby the indication lamp 9*c* of the outdoor fueling state indicator 9 is turned off.

As is obvious from the above explanations, the fueling system of the invention can be established by employing the conventional liquidation machine such as a POS terminal, of which processing capacity can efficiently be used without the decrease of the processing speed by the fueling system of the present invention wherein the outdoor fueling state indicator 9 is under the control of the indoor fueling state indicator 8.

What is claimed is:

1. A fueling system comprising:

a plurality of fueling units;

a control unit for controlling signals transmitted from said fueling units, settling accounts, and transmitting signals to an indoor fueling state indicator indicating fueling states of said plurality of fueling units indoors; and an outdoor fueling state indicator indicating fueling states of said plurality of fueling units outdoors by receiving signals directly from said indoor fueling state indicator.

2. The fueling system as claimed in claim 1, wherein said control unit comprises a point-of-sales terminal controlling signals transmitted from said fueling units and settling accounts, said indoor fueling state indicator indicating fueling states indoors by receiving signals from said point-of-sales terminal, signals from said point-of-sales terminal being transmitted to said outdoor fueling state indicator invariably through said indoor fueling state indicator.

3. The fueling system as claimed in claim 2, wherein said fueling unit comprises nozzle switches, flow-meters and a fueling-unit control part, said fueling-unit control part outputting a fueling start signal and fueling completion signal to said point-of-sales terminal responding on and off signals of each of said nozzle switches, and outputting a flow-volume signal from said flow-meters to said point-of-sales terminal; said point-of-sales terminal comprises a liquidation-machine control part which outputs a fueling signal, fueling suspension signal, and fueling completion signal, respectively by the receipt of said flow-volume signal by the suspension of said fueling signal and by the receipt of said fueling completion signal, and a settlement completion signal at the stage of the completion of settlement; said indoor fueling state indicator comprises an indoor-fueling-state-indicator control part, and indoor indication lamps for each of said fueling units, said indoor-fueling-state-indicator control part turning on, turning on and off, and turning off said indoor indication lamps respectively when said indoor-fueling-state-indicator control part receives said fueling signal, said fueling completion signal and said settlement completion signal, said indoor-fueling-state-indicator control part outputting said fueling signal, said fueling suspension signal and said fueling completion signal to said outdoor fueling state indicator; and said outdoor fueling state indicator comprises an outdoor-fueling-state-indicator control part and outdoor indication lamps for each of said fueling units and said indoor fueling state indicator, said outdoor-fueling-state-indicator control part turning on, turning on and off, and turning off said outdoor indication lamps respectively when said outdoor-fueling-state-indicator control part receives said fueling signal, said fueling suspension signal, and said fueling completion signal.

4. The fueling system as claimed in claim 3, wherein said indoor fueling state indicator further comprises an indoor communicator, and said outdoor fueling state indicator further comprises an outdoor communicator, said indoor-fueling-state-indicator control part causing said indoor communicator to ring by receiving said fueling completion signal, said outdoor-fueling-state-indicator control part causing said outdoor communicator to ring by receiving said fueling suspension signal.

5. The fueling system as claimed in claim 1, further comprising a leaving-propriety indicating unit for each of said fueling units, for showing whether an automobile to be fueled has been made fueled with the settlement being completed.

6. A fueling system comprising:

one or more of fueling units;

a liquidation machine mainly for controlling signals transmitted from said fueling units, and settling accounts;

an indoor fueling state indicator for indicating fueling states indoors by receiving signals from said liquidation machine; and an outdoor fueling state indicator for indicating fueling states outdoors by receiving signals from said indoor fueling state indicator, signals from said liquidation machine being transmitted to said outdoor fueling state indicator invariably through said indoor fueling state indicator.

7. The fueling system as claimed in claim 6, wherein said liquidation machine is a point-of-sales terminal.

8. The fueling system as claimed in claim 6, wherein said fueling unit and indoor fueling state indicator constitutes a control unit.

9. The fueling system as claimed in claim 6, wherein said fueling unit comprises nozzle switches, flow-meters and a fueling-unit control part, said fueling-unit control part outputting a fueling start signal and fueling completion signal to said liquidation machine responding on and off signals of each of said nozzle switches, and outputting a flow-volume signal from said flow-meters to said liquidation machine; said liquidation machine comprises a liquidation-machine control part which outputs a fueling signal, fueling suspension signal, and fueling completion signal, respectively by the receipt of said flow-volume signal, by the suspension of said fueling signal and by the receipt of said fueling completion signal and a settlement completion signal at the stage of the completion of settlement; said indoor fueling state indicator comprises an indoor-fueling-state-indicator control part, and indoor indication lamps for each of said fueling units, said indoor-fueling-state-indicator control part turning on, turning on and off, and turning off said indoor indication lamps respectively when said indoor-fueling-state-indicator control part receives said fueling signal, said fueling completion signal and said settlement completion signal, said indoor-fueling-state-indicator control part outputting said fueling signal, said fueling suspension signal and said fueling completion signal to said outdoor fueling state indicator; and said outdoor fueling state indicator comprises an outdoor-fueling-state-indicator control part and outdoor indication lamps for each of said fueling units and said indoor fueling state indicator, said outdoor-fueling-state-indicator control part turning on, turning on and off, and turning off said outdoor indication lamps respectively when said outdoor-fueling-state-indicator control part receives said fueling signal, said fueling suspension signal, and said fueling completion signal.

10. The fueling system as claimed in claim 9, wherein said indoor fueling state indicator further comprises indoor communicator, and said outdoor fueling state indicator further comprises an outdoor communicator, said indoor-fueling-state-indicator control part causing said indoor communicator to ring by receiving said fueling completion signal, said outdoor-fueling-state-indicator control part causing said outdoor communicator to ring by receiving said fueling suspension signal.

11. The fueling system as claimed in claim 6, further comprising a leaving-propriety indicating unit for each of said fueling units, for showing whether an automobile to be fueled has been made fueled with the settlement being completed.

* * * * *